US008077054B1

(12) United States Patent
Aarons

(10) Patent No.: US 8,077,054 B1
(45) Date of Patent: Dec. 13, 2011

(54) GARAGE DOOR OPENER AND PARKING GUIDE COMBINATION

(76) Inventor: Ronald W. Aarons, Westlake Village, CA (US)

( * ) Notice: Subject to any disclaimer, the term of this patent is extended or adjusted under 35 U.S.C. 154(b) by 732 days.

(21) Appl. No.: 12/145,685

(22) Filed: Jun. 25, 2008

(51) Int. Cl.
*B60Q 1/48* (2006.01)

(52) U.S. Cl. ..... 340/932.2; 340/555; 340/556; 340/557; 340/5.71; 362/511; 116/28 R

(58) Field of Classification Search ..... 340/932.2, 340/539.1, 539.11, 557, 686.1, 942, 5.7, 340/5.71, 555, 556; 116/28 R; 250/491.1; 362/511

See application file for complete search history.

(56) References Cited

U.S. PATENT DOCUMENTS 6,040,787 A 3/2000 Durham
6,191,706 B1 2/2001 Kositkun
D446,877 S 8/2001 Lester
6,946,973 B1 * 9/2005 Yanda ..... 340/932.2
6,989,760 B2 1/2006 Dierking et al.
7,102,296 B1 * 9/2006 Munter et al. ..... 315/276
7,812,742 B2 * 10/2010 Pankowski ..... 340/932.2
7,862,209 B2 * 1/2011 Fitzgibbon et al. ..... 362/294
2002/0140576 A1 10/2002 Simon
2003/0160705 A1 8/2003 Guetz
2005/0253729 A1 11/2005 Su

* cited by examiner

*Primary Examiner* — Hung T. Nguyen

(57) ABSTRACT

A garage door opener and parking guide combination includes a housing that includes a drive assembly mechanically coupled to a garage door to selectively open or close the garage door when the drive assembly is activated. The housing is attached to a ceiling of a garage containing the garage door. A light bulb socket is in electrical communication with a control of the drive assembly and receiving electricity while the drive assembly is activated. A male connector is removably extended in and electrically coupled to the light bulb socket. A light bulb is electrically coupled to the male connector and emits light when electricity is supplied to the light bulb socket. A laser light assembly is electrically coupled to the male connector and emits laser light when the male connector receives electricity from the light bulb socket.

1 Claim, 9 Drawing Sheets

GARAGE DOOR OPENER AND PARKING GUIDE COMBINATION

BACKGROUND OF THE INVENTION

Field of the Invention

The present invention relates to parking guide devices and more particularly pertains to a new parking guide device for assisting a person in properly parking in their garage.

SUMMARY OF THE INVENTION

The present invention meets the needs presented above by generally comprising a housing that includes a drive assembly mechanically coupled to a garage door to selectively open or close the garage door when the drive assembly is activated. The housing is attached to a ceiling of a garage containing the garage door. A light bulb socket is in electrical communication with a control of the drive assembly and receiving electricity while the drive assembly is activated. A male connector is removably extended in and electrically coupled to the light bulb socket. A light bulb is electrically coupled to the male connector and emits light when electricity is supplied to the light bulb socket. A laser light assembly is electrically coupled to the male connector and emits laser light when the male connector receives electricity from the light bulb socket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
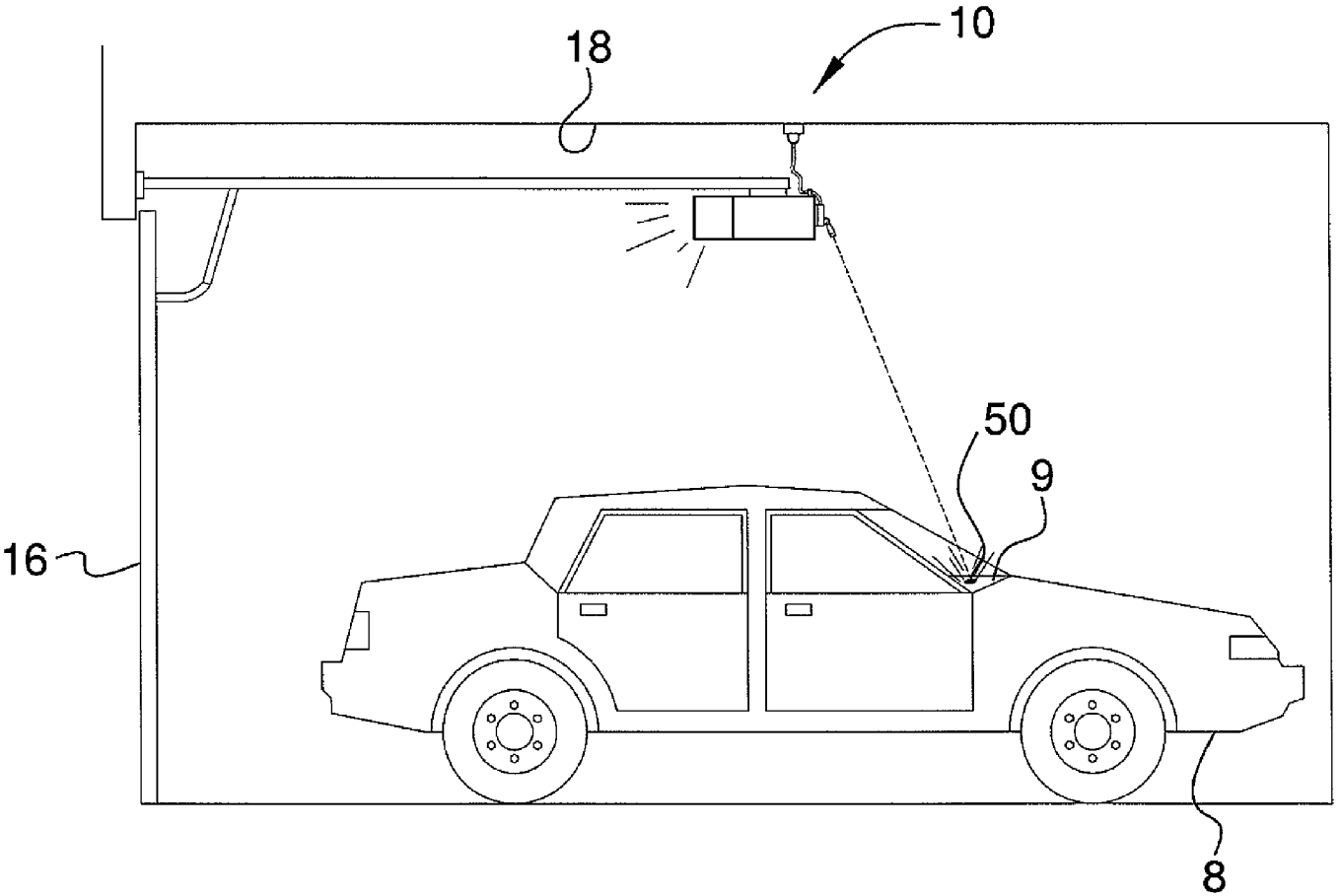
FIG. 1 is a side in-use view of a garage door opener and parking guide combination according to the present invention.

With reference now to the drawings, and in particular to FIGS. 1 through 10 thereof, a new parking guide device embodying the principles and concepts of the present invention and generally designated by the reference numeral 10 will be described.

As best illustrated in FIGS. 1 through 10, the garage door opener and parking guide combination 10 generally comprises a housing 12 that includes a drive assembly 14, which includes an electrical motor 15, mechanically coupled to a garage door 16 to selectively open or close the garage door 16 when the drive assembly 14 is activated. The housing 12 is attached to a ceiling 18 of a garage containing the garage door 16. A light bulb socket 20 is in electrical communication with a control 22 of the drive assembly 14 and receives electricity while the drive assembly 14 is activated. Typically, the light bulb socket 20 also receives electricity for a pre-selected time after the drive assembly 14 has been actuated to provide light for a person moving within the garage. A translucent covering 24 is removably attached to the housing 12 and positioned over the light bulb socket 20. The drive assembly 14 is remotely controlled and the entire housing 12, drive assembly 14 and light bulb socket 20 form a conventional garage door opening assembly.

A male connector 26 is removably extended in and electrically coupled to the light bulb socket 20. A light bulb 28 is electrically coupled to the male connector 26 and emits light when electricity is supplied to the light bulb socket 20.

Figure 2:
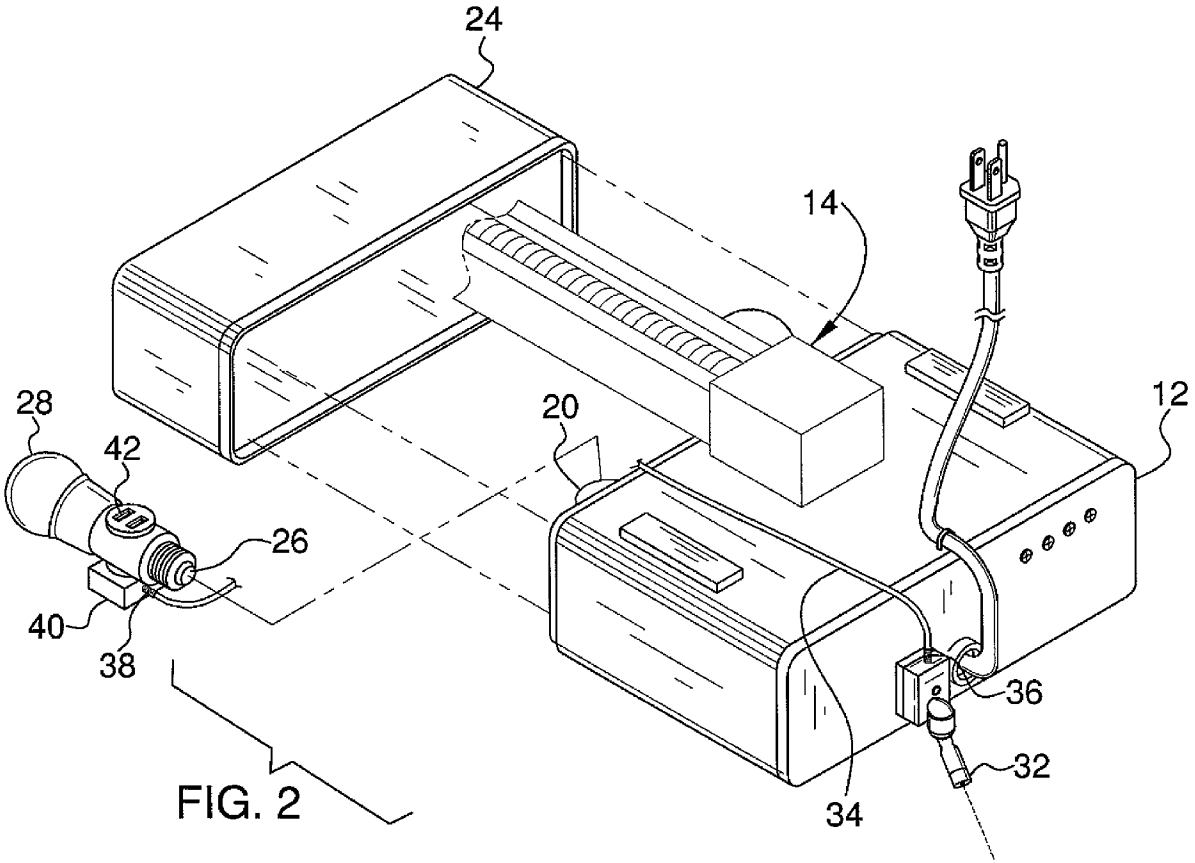
FIG. 2 is an exploded perspective view of the present invention.
Figure 3:
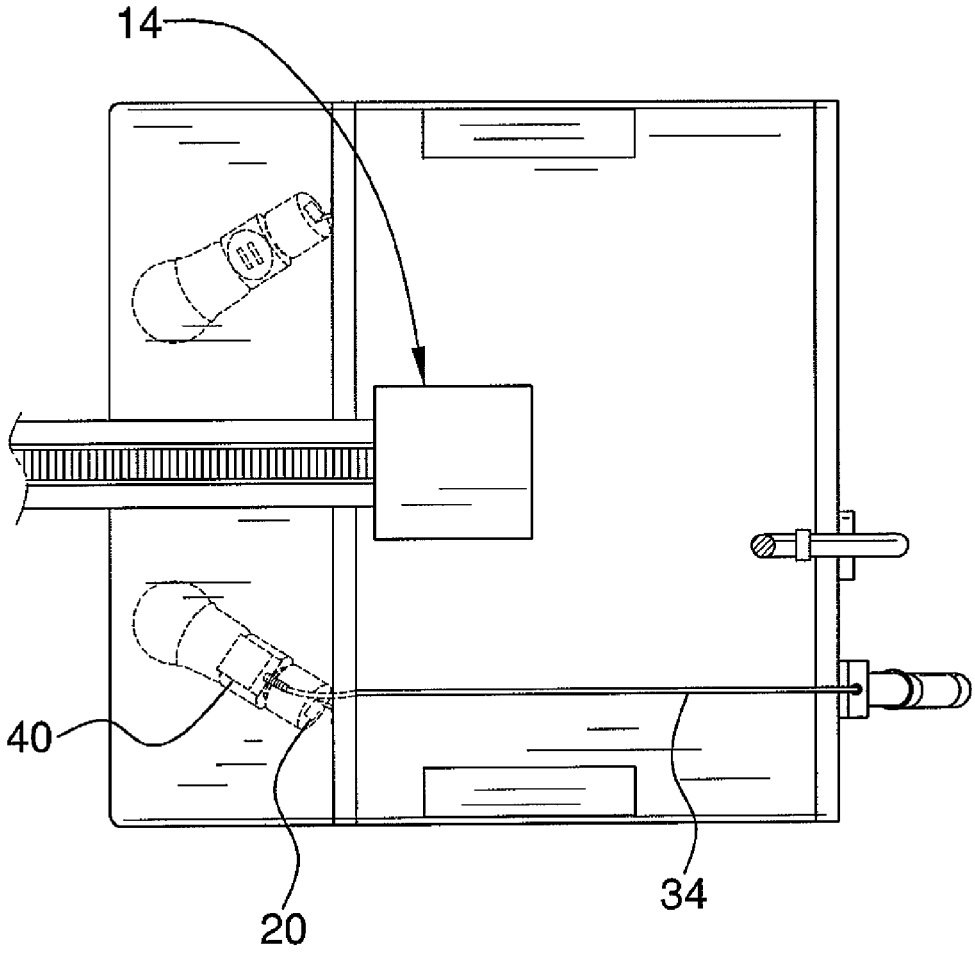
FIG. 3 is a top view of the present invention.
Figure 4:
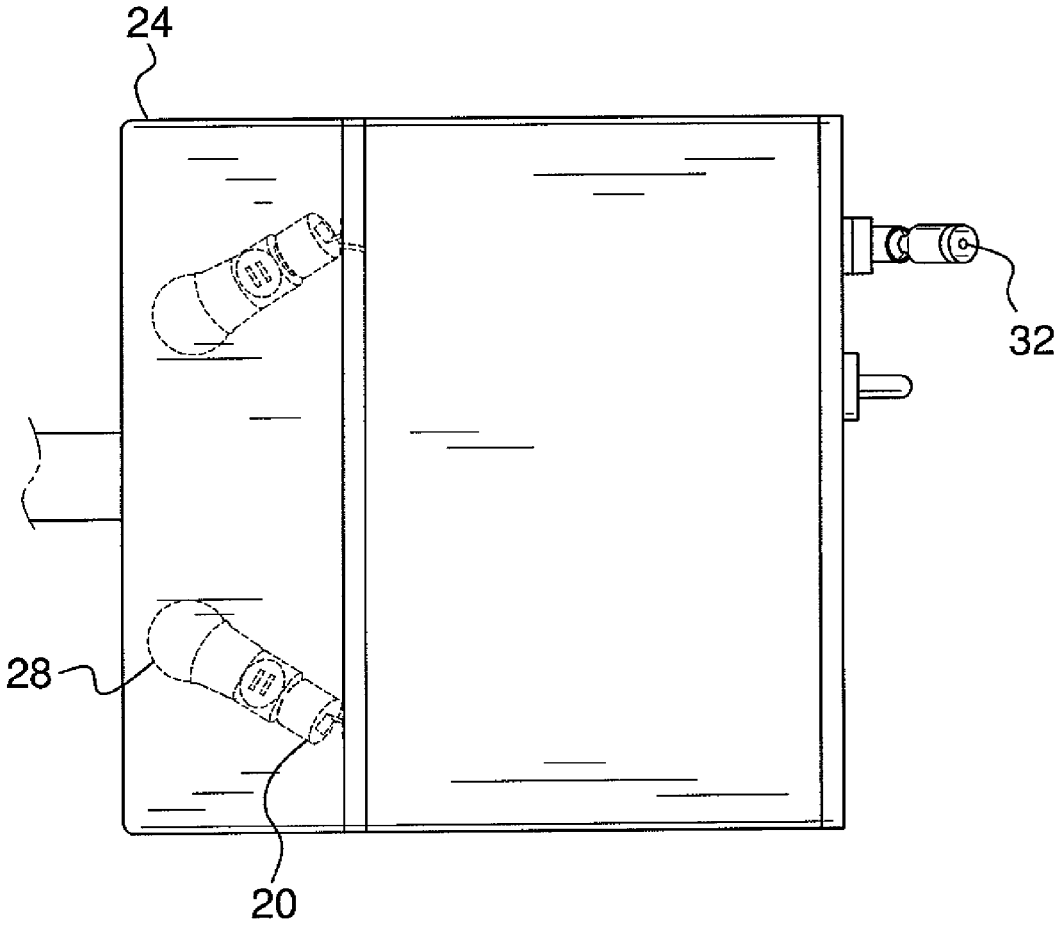
FIG. 4 is a bottom view of the present invention.
Figure 5:
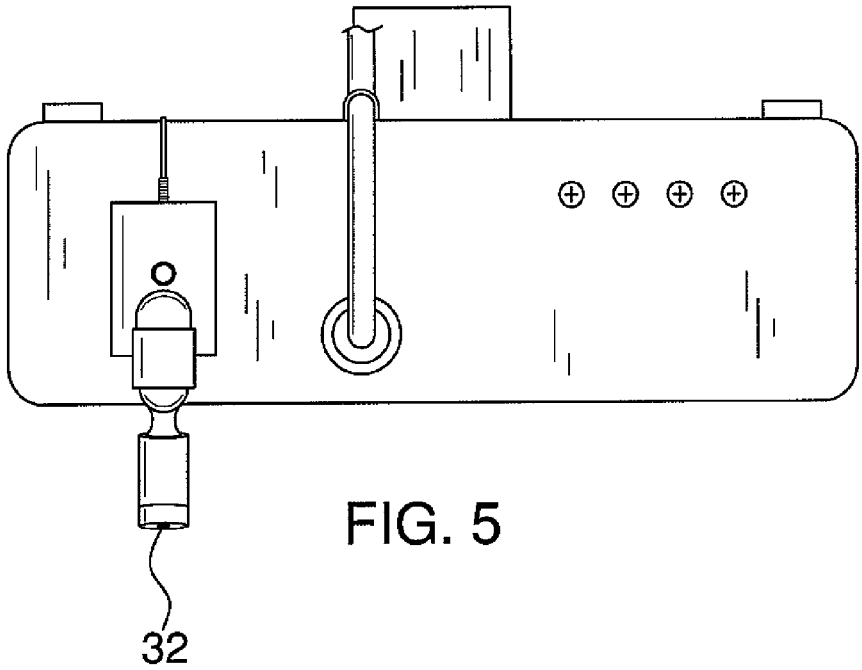
FIG. 5 is a front view of the present invention.
Figure 9:
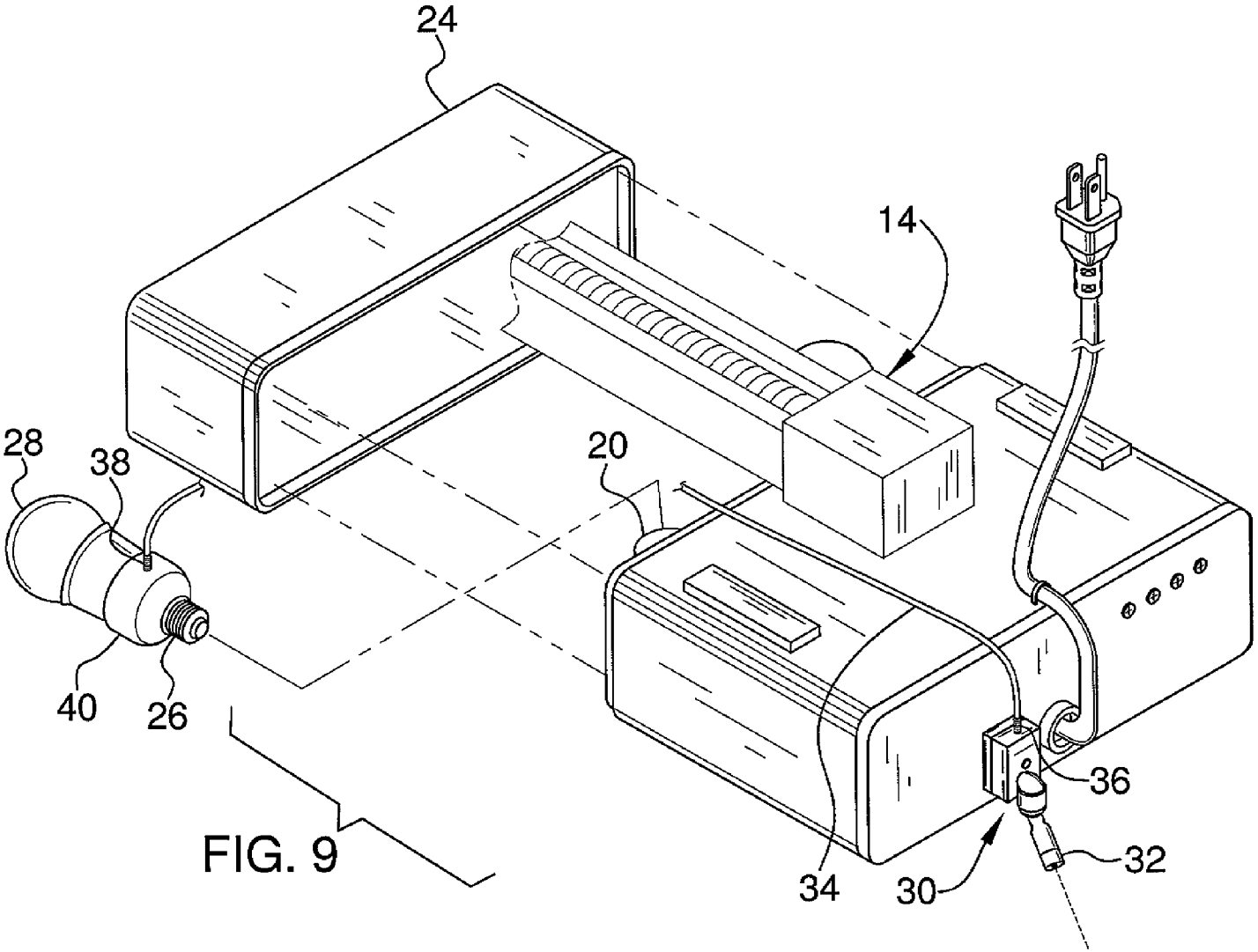
FIG. 9 is an exploded perspective view of a third embodiment of the present invention.
Figure 10:
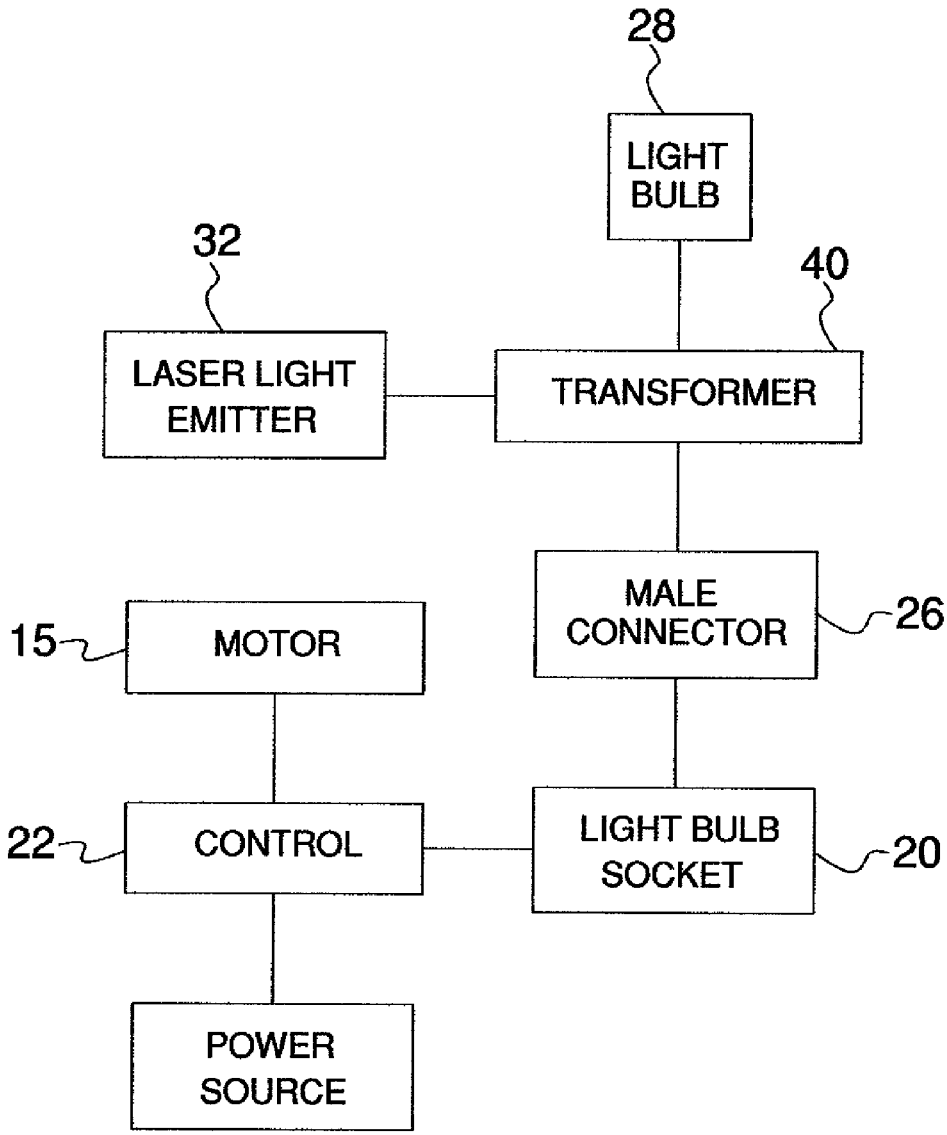
FIG. 10 is a schematic view of the present invention.

A laser light assembly 30 is electrically coupled to the male connector 26 and emits laser light when the male connector 26 receives electricity from the light bulb socket 20. The laser light assembly 30 includes a laser light emitter 32 directed to emit light to indicate a point to where a vehicle 8 should pull forward in the garage. The laser light emitter 32 is mounted on the housing 12 and is directed downward to strike a dashboard 9 of the vehicle 8 when the vehicle 8 is properly positioned within the garage. The laser light emitter may be mounted on the housing 12 with a magnet 52. The laser light emitter is rotatably or pivotally coupled to the housing 12 to facilitate directing laser light emitted by the laser light emitter 32. An electrical cable 34 has a first end 36 and a second end 38. The first end 36 is electrically coupled to the laser light emitter 32. A transformer 40 is electrically coupled to the second end 38 of the electrical cable 34. The transformer 40 is in electrical communication with the male connector 26. This may be accomplished by different structures. FIG. 2 shows a conventional light bulb 28 coupled to a power socket adapter 42 which includes the male connector 26 and the transformer 40 electrically coupled to the power socket adapter 42. FIG. 9 shows a third embodiment including a light bulb 28 coupled to an integrated transformer 40 and male connector 26. In the first embodiment, the transformer 40 is removable from the male connector 26.

Figure 6:
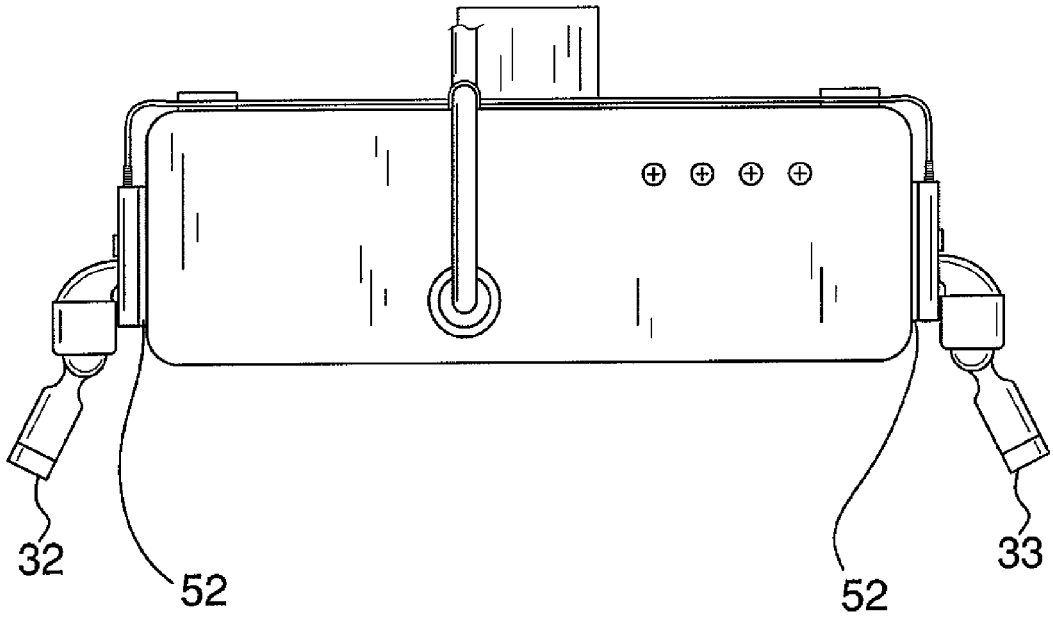
FIG. 6 is a front view of a second embodiment of the present invention.
Figure 7:
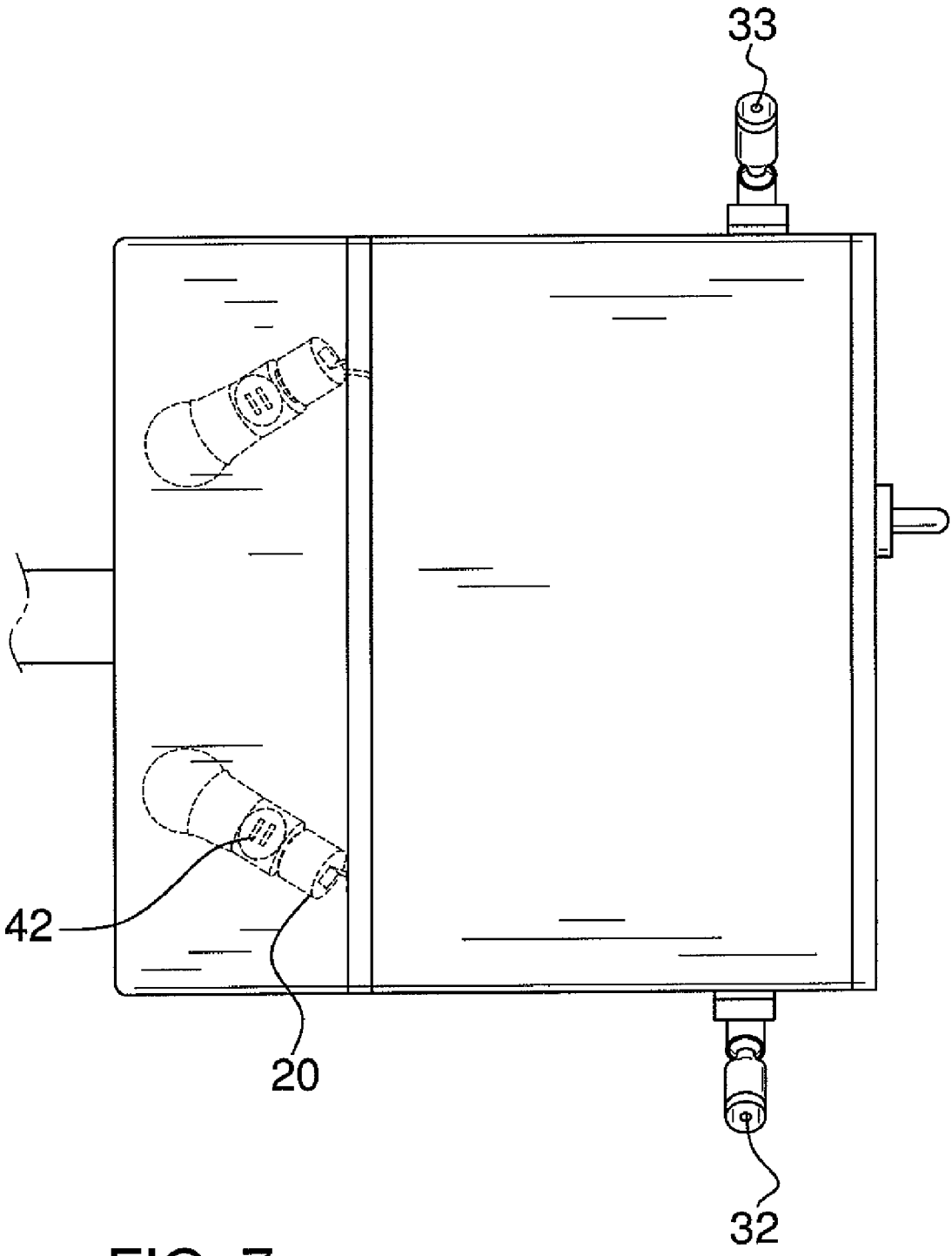
FIG. 7 is a bottom view of the second embodiment of the present invention.
Figure 8:
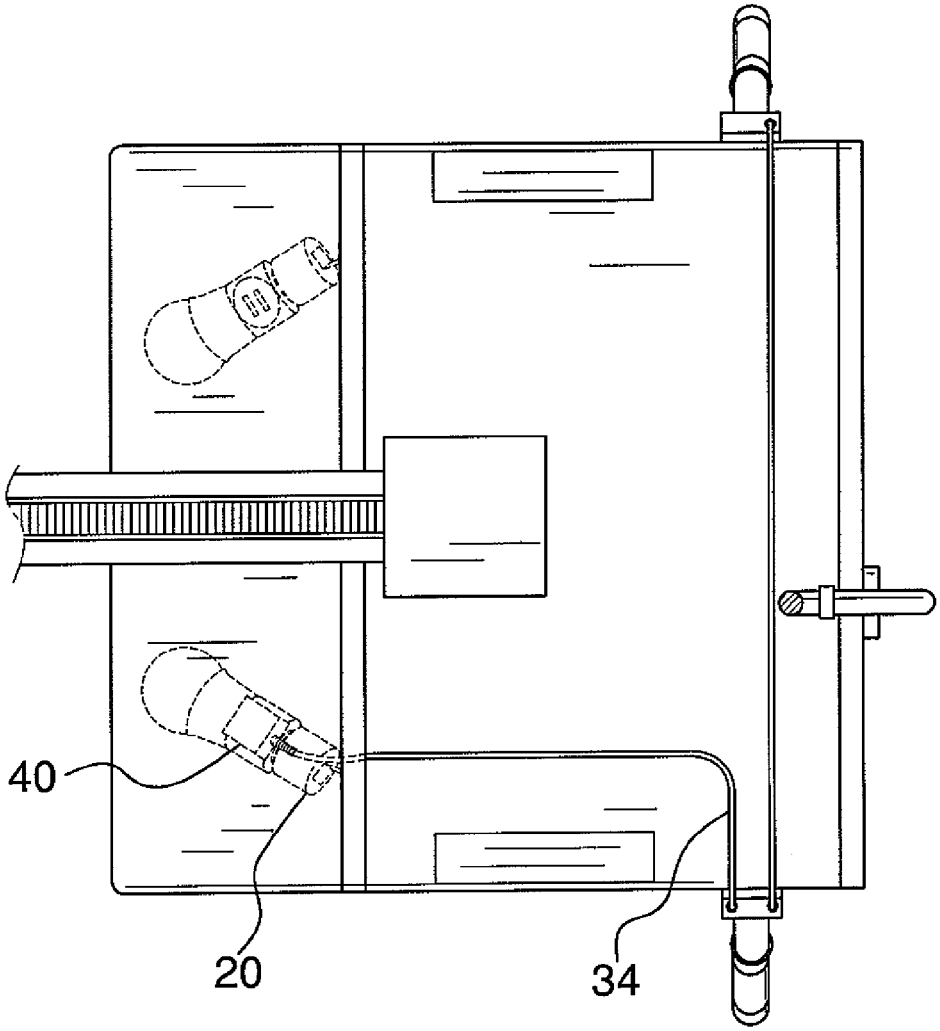
FIG. 8 is a top view of the second embodiment of the present invention.

A second embodiment is found in FIGS. 6-8 and includes the electrical cable 34 being electrically coupled to a pair of laser light emitters 32, 33. Each of the laser light emitters 32, 33 are mounted to the housing 12 by magnets 52, and may be positioned on opposite sides of the housing 12, and each will be directed for a different vehicle 8 so that the combination 10 may be used for a double stall garage having a single garage door 16 and garage door opener.

In use, a person connects the transformer 40 to the light bulb socket 20 as explained above and shown in the figures. When a user of the combination 10 opens the garage door 16, the light bulb socket 20 will power the laser light emitter 32. The user will know when to stop driving forward with the vehicle 8 into the garage when the laser light emitter 32 strikes a particular portion of the vehicle 8, such as the dashboard 9. When the light bulb socket 20 no longer powers on the light bulb 28, the laser light emitter 32 is also turned off. The cable

34 allows the user to place the laser light emitter 32 where they choose on an outer surface of the housing 12. A reflective panel 50 may be placed on the dashboard 9 to act as a target for the laser light emitter 32.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garage door opener and parking guide combination comprising:

a housing including a drive assembly mechanically coupled to a garage door to selectively open or close the garage door when said drive assembly is activated, said housing being attached to a ceiling of a garage containing the garage door, a light bulb socket being in electrical communication with a control of said drive assembly and receiving electricity while said drive assembly is activated and for a pre-selected time thereafter;

a translucent covering being removably attached to said housing and positioned over said light bulb socket;

a male connector being removably extended in and electrically coupled to said light bulb socket, a light bulb being electrically coupled to said male connector and emitting light when electricity is supplied to said light bulb socket;

a laser light assembly being electrically coupled to said male connector and emitting laser light when said male connector receives electricity from said light bulb socket, said laser light assembly including;

a laser light emitter directed to emit light to indicate a point to where a vehicle should pull forward in the garage, said laser light emitter being rotatably mounted on said housing and being directed downward to strike a dashboard of the vehicle when the vehicle is properly positioned within the garage;

an electrical cable having a first end and a second end, said first end being electrically coupled to said laser light emitter; and a transformer being electrically coupled to said second end of said electrical cable, said transformer being in electrical communication with said male connector, said transformer being removable from said male connector.

* * * * *